US008853104B2

(12) United States Patent
Olsson et al.

(10) Patent No.: US 8,853,104 B2
(45) Date of Patent: Oct. 7, 2014

(54) INDUSTRIAL FABRIC WITH POROUS AND CONTROLLED PLASTICIZED SURFACE

(75) Inventors: Lennart Olsson, Simlångsdalen (SE); Francis L. Davenport, Ballston Lake, NY (US)

(73) Assignee: Albany International Corp., Albany, NY (US)

( * ) Notice: Subject to any disclaimer, the term of this patent is extended or adjusted under 35 U.S.C. 154(b) by 1847 days.

(21) Appl. No.: 11/820,658

(22) Filed: Jun. 20, 2007

(65) Prior Publication Data

US 2008/0318486 A1 Dec. 25, 2008

(51) Int. Cl.
*D21F 7/08* (2006.01)
*D21F 1/00* (2006.01)

(52) U.S. Cl.
CPC ..... *D21F 7/083* (2013.01); *D21F 7/086* (2013.01); *D21F 1/0027* (2013.01)
USPC ..... 442/97

(58) Field of Classification Search
USPC ..... 162/109, 118, 119, 120, 121, 122; 442/59, 76, 97, 218, 224, 225, 226, 442/238, 240, 241, 242, 246, 251, 254, 255, 442/323
See application file for complete search history.

(56) References Cited

U.S. PATENT DOCUMENTS

| | | | | |
|---|---|---|---|---|
| 4,529,643 | A | 7/1985 | Lundstrom | |
| 4,772,504 | A | 9/1988 | Andresen | |
| 5,073,235 | A | 12/1991 | Trokhan | |
| 5,525,410 | A | 6/1996 | Hansen | |
| 5,549,967 | A * | 8/1996 | Gstrein | 442/200 |
| 2006/0096653 | A1 | 5/2006 | Eagles | |
| 2008/0000598 | A1 * | 1/2008 | Dyer et al. | 162/109 |
| 2008/0038975 | A1 | 2/2008 | Weiss et al. | |

FOREIGN PATENT DOCUMENTS

| | | |
|---|---|---|
| GB | 2 200 867 A | 8/1988 |
| WO | WO 99/41447 | 8/1999 |
| WO | WO 99/61130 | 12/1999 |
| WO | WO 02/053832 | 7/2002 |
| WO | WO 03/091498 | 11/2003 |
| WO | WO 2005/098128 A | 10/2005 |

OTHER PUBLICATIONS

International Search Report and Written Opinion from European Patent Office acting as the International Searching Authority for corresponding international application PCT/US2008/065797, mailed by ISA on Sep. 15, 2008.

* cited by examiner

*Primary Examiner* — Arti Singh-Pandey

(74) *Attorney, Agent, or Firm* — Frommer Lawrence & Haug LLP; Ronald R. Santucci

(57) ABSTRACT

The present invention relates to a process of obtaining an industrial fabric with porous and controlled plasticized surface and an industrial fabric with the mentioned characteristics thereof. The invention also relates to an industrial fabric such as press fabric for use in the press section of a paper machine with enhanced aesthetic properties by the use of plasticizers and optional heat and/or pressure treatment.

20 Claims, 1 Drawing Sheet

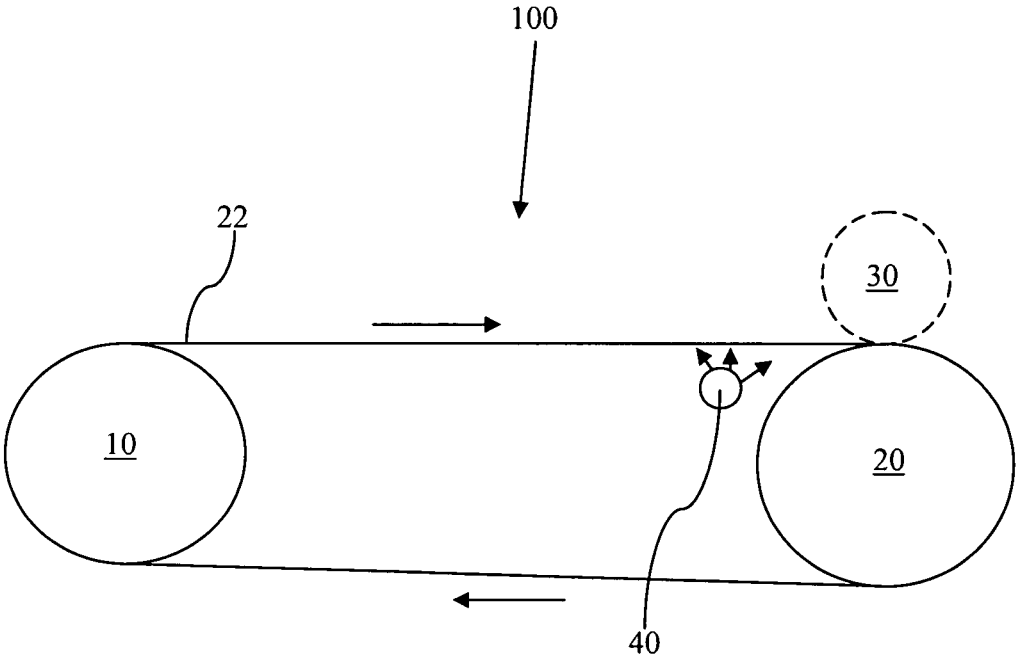
100
22
30
10
20
40

INDUSTRIAL FABRIC WITH POROUS AND CONTROLLED PLASTICIZED SURFACE

BACKGROUND OF THE INVENTION

1. Field of the Invention

The invention relates to a process to obtain an industrial fabric with a porous and controlled plasticized surface. More particularly it relates to a process to obtain paper machine clothing, primarily press fabrics with enhanced properties by use of plasticizers and optional heat treatment.

2. Description of the State of the Art

Improved sheet smoothness has become a major requirement in the world marketplace today. Greater fabric smoothness and uniformity results in more uniform pressure distribution under load, and consequently, a smooth paper surface. Aesthetically smooth press fabric surfaces are able to meet those needs. Numerous attempts have been made to try to achieve sheet smoothness.

An example of surface modification of paper machine clothing (PMC) with a polymeric coating process can be found in WO 03/091498 wherein a press fabric with a compacted surface comprising a base structure, and a batt fiber layer is disclosed. The compaction is made with a polymeric treatment with e.g. polyurethane, polyacrylate, acrylic resin, epoxy, phenolic resin etc. The polymeric treatment is a water dispersion, and the fabric surface is smoothed by grinding and sanding. Though this method of smoothing the surface can be effective, the fibers on the surface layers are damaged due to the grinding process, rendering the fabric with overall poor wear resistance. Furthermore, when using water based coatings on a porous substrate, it is difficult to adequately control placing the coating on the surface and controlling the depth of penetration.

With regard to WO 02/053832, it refers to the method of making a similar compacted press fabric with different properties at the center and edge portions of the press fabric. The drawback of using such a press fabric is the variation of thickness in the paper produced due to the irregularity in properties along the cross machine direction of the press fabric. Higher or lower permeability in the edge portions can lead to the variation in extraction of water content along the cross machine direction.

Turning now to GB 2200867, U.S. Pat. No. 4,529,643, and U.S. Pat. No. 4,772,504 they each relate to somewhat similar press fabrics that have a smooth surface due to the use of fine fibers, and a surface of substantially low permeability due to its treatment with a rubber or resin emulsion or a plastic material applied to the surface layer. The use of fine fibers have shown a substantial reduction in the wear resistance of press fabrics and the application of rubber and plastic material to smooth the surface layer of the press fabric can tend to wear away over time, reducing the effectiveness of the structure.

Similar to the art discussed above, WO 99/41447 and WO 99/61130 relate to phase separation members, wherein a layer of fluoropolymer is applied to the outer surface of the phase separation member, which is a coagulated polymer material such as PET, PA, PP or PAN.

It should also be noted that current needled press fabrics have needle tracks which may cause some degree of non-uniform pressure distribution and the potential for sheet marking. Therefore, there is still a need in the art for a fabric which has the requisite smoothness, which also can be efficiently produced and can be obtained from a wide variety of fiber types, and still maintain excellent wear resistance.

The purpose of this invention is to use a plasticizer for the material e.g. polyamide that makes up the yarns and/or batt of the press fabric structure, in order to enhance press fabric smoothness and uniformity.

The present invention describes a press fabric and a process of making thereof which overcomes the aforenoted problems associated with prior art fabrics described above.

SUMMARY OF THE INVENTION

The present invention relates to industrial fabrics, such as press fabrics, press belts and transfer belts with enhanced properties such as surface smoothness. The enhancement of the fabric properties is due to the use of a plasticizer and optional combination of heat and/or pressure which acts upon the material components of the fabric structure.

It is an object of the instant invention to provide industrial fabrics with a porous surface that exhibits enhanced properties, specifically smoothness, due to the use of plasticizers and optional heat treatment.

It is a further object of the invention to provide an industrial fabric with high wear resistance by the use of plasticizers and heat treatment.

It is a further object of the invention to provide an industrial fabric with a porous surface that is hydrophilic.

It is a further object of the invention to provide an industrial fabric such as a press fabric with a porous surface with greater fabric smoothness and uniformity which results in more uniform pressure distribution under load in a press nip, resulting in a smooth paper surface without any sheet marking and greater sheet dryness.

It is a further object of the invention to provide an industrial fabric with sufficient fiber to fiber bonding within the structure of the fabric by enhancing fiber to fiber fusion.

It is a further object of the invention to provide an industrial fabric with a porous surface via the use of variable parameters such as the amount of plasticizer for the treatment of the fabric, process temperature, pressure and time/speed of treatment.

It is a further object of the invention to provide an industrial fabric that due to varying the above parameters, with a surface which is essentially slightly permeable to impermeable that will also function as a press belt or transfer belt.

For a better understanding of the invention, its operating advantages and specific objects attained by its uses, reference is made to the accompanying descriptive matter in which preferred, but non-limiting, embodiments of the invention are illustrated.

Terms "comprising" and "comprises" in this disclosure can mean "including" and "includes" or can have the meaning commonly given to the term "comprising" or "comprises" in US Patent Law. Terms "consisting essentially of" or "consists essentially of" if used in the claims have the meaning ascribed to them in US Patent Law. Other aspects of the invention are described in or are obvious from (and within the ambit of the invention) the following disclosure.

BRIEF DESCRIPTION OF THE DRAWINGS

The accompanying drawing, which is included to provide a further understanding of the invention and is incorporated in and constitute a part of this specification, illustrates embodiments of the invention and together with the description serve to explain the principles of the invention. In the drawings:

FIG. 1 is a finishing machine used in making an industrial fabric, according to one aspect of the invention.

DETAILED DESCRIPTION OF THE INVENTION

Industrial fabrics referred to herein refer to an endless belt such as a forming fabric, press fabric, or dryer fabric (paper machine clothing). It can also be used as a papermaking press belt or transfer belt. It can also be a fabric used in the production of nonwovens by processes such as melt blowing or spun bonding, or a fabric used in textile finishing processes such as a tanning belt. Furthermore, these belts can have a porous structure that can be permeable or impermeable.

An industrial fabric, particularly a press fabric, is used in the press section of a papermaking machine for dewatering the paper sheet in a press nip. The press fabric comprises a fabric or support structure which may be made of a yarn material and is endless in the machine direction of the press fabric. Usually a layer or layers of batt fiber is attached thereto using conventional needling equipment. The support structure or fabric as used in the present invention includes woven, nonwovens such as knitted, extruded mesh, spiral-link, machine direction ("MD") or cross-machine direction ("CD") yarn arrays, and spiral wound strips of woven and nonwoven materials. The support structure or fabric may or may not include a batt layer added on either surface of the fabric. The fabric may include yarns of any type and form known to those skilled in the art, for example, monofilament, plied monofilament, multifilament or plied multifilament as well as multistrand yarns as taught in commonly assigned U.S. Pat. No. 5,525,410, whose teachings are incorporated herein by reference. The fabric may be single layered or multi-layered or a multilayered woven structure. Structures which have no batt e.g. a multilayer woven structure made of multifilament, BCF (bulk continuous filament), texturized multifilament or multistrand yarn, in either or both MD and CD, may also be used. Laminates of one or more of the above mentioned structures can be used as well. A fibrous component such as batt produced by carding, can be attached to at least the outer surface of the base support structure. Other nonwoven material, such as produced by airlaying, spunbonding, etc. may instead be attached by some method such as that of an adhesive. The yarns forming the support structure or fabric are typically extruded from any one of the synthetic polymeric resins, such as polyamide, used for this purpose by those of ordinary skill in the industrial fabric arts. However, each polymer may need a different plasticizer or combinations thereof, and a separate set of process conditions to achieve the desired smooth surface.

In one embodiment of the invention, the layer or layers of fiber material or batt added on either surface of the support structure or fabric, e.g. made of polyamide, are treated using a plasticizer. Sorption of the chosen plasticizer triggers a change in the glass transition temperature of the fiber material and the use of heat and/or pressure causes fiber flattening and densification of the entire batt component. This effect is more pronounced in fabrics having low melt fibers, where the fiber to fiber bonding is enhanced due to lowering of glass transition temperature using a plasticizer, thereby bringing them close to, or to, a melting stage, and the use of heat and pressure thereafter causes the fibers to bond thoroughly to adjacent fibers. With the appropriate amount of plasticizer, time, temperature, and applied pressure to the fabric structure, desired fiber to fiber fusion can be achieved. This improves both surface smoothness and surface integrity (wear resistance) of the fabric. However, structures without any fiber material added on either of the surfaces can also be used. For example, multilayer woven structures comprising polyamide yarns such as bulk-continuous filament (BCF), texturized, or multistrand yarns as taught in commonly assigned U.S. Pat. No. 5,525,410, may also be used as the substrate herein and may be processed using the application of the chosen plasticizer with optional heat and, if required, pressure to form a smooth and porous surface thereoon.

The plasticizer used in the present invention is preferably a water soluble liquid, nonionic polyalkoxy or polyhydroxy compound. The water soluble liquid can be selected from the group consisting of glycerin/water and resorcinol/water. Examples of some commonly known plasticizers that can also be used in the present invention include, but are not limited to, dipropylene glycol, ethylene glycol, resorcinol, glycerol, diethylene glycol dibenzoate, triethylene glycol, tetraethylene glycol, bis(n-butyl)phthalate, butyl benzyl phthalate, di(n-octyl)phthalate, derivates thereof, combinations, and mixtures thereof and other polymeric plasticizers commonly known in the art. For example, a mixture of glycerol and dipropylene glycol has been found to be effective.

It is important to maintain a smooth surfaced press fabric throughout its service life, so that the paper produced will not show any non-uniformity such as marking from the yarns.

By treating the press fabric, for example, with a glycerol-water solution and letting the fabric pass over a hot roll (with or without a mating pressure roll), the surface in contact with the heated roll can, under proper conditions, plasticize and form a smooth porous, permeable surface on the fabric. The process can also form an almost or essentially impermeable surface and subsequently can be perforated by a separate process if desired. Otherwise such a structure with a smooth essentially impermeable surface can be utilized as a press belt or transfer belt or other such structures known to those skilled in the art. The plasticizing can be controlled to a desired level/thickness based on the amount of glycerol and water, and the degree of deformation of the surface of the fabric can be controlled to a desired level and/or thickness based on the roll temperature, pressure and time/speed of treatment. The process is controlled by letting the water-glycerol migrate towards the surface to be smoothed, letting the water evaporate and, if appropriate, simultaneously treating the fabric with slight/heavy pressure thereby causing the fibers to deform and cause fiber to fiber bonding. The heat here is applied to only the paper contacting side of the fabric when the intention is to plasticize the paper-side surface. Under certain conditions a pressure roll may not be needed at all.

In one embodiment, a two-roll finishing machine 100 as shown in FIG. 1 may be used to apply the heat and pressure in the present invention. A system such as a kiss roll or spray nozzles 40 can be used to apply the plasticizer as shown in FIG. 1. The finishing machine is typically a machine having two or more parallel spaced apart rolls, which apply uniform pressure or tension on fabric 22 as the fabric 22 is passed around the two rolls. In this embodiment, the finishing machine 100 is defined by a stretch roll 10 and a roll 20, separated by a distance, which may apply the desired amount of heat and pressure on the fabric 22 being processed. Roll 20 may also be heated. The degree of plasticizing can be controlled to a desired level and/or thickness based on the amount of plasticizer used, and the degree of deformation can be controlled to a desired level and/or thickness by controlling the roll temperature and/or, fabric tension by spacing the two rolls apart or the time and/or speed of treatment. Further, the machine 100 may include an optional loaded mating roll 30, to apply additional pressure on the fabric 22.

In another embodiment of the present invention, fabrics with an extremely smooth porous surface can be obtained by applying one or more layers of batt fiber comprising a blend of polyamide (PA) and certain other fibers that do not react with the chosen plasticizer, for example fibers of rayon or acrylic etc, to a support structure or fabric usually by needling. Such a fabric is then installed on a finishing machine as is shown on FIG. 1 and subsequently applying a plasticizer for polyamide fibers, with optional heat and pressure to the structure. In using such fabrics that incorporate a blend of PA and certain other fibers in the structure, the non-PA fibers will fibrillate and be worn off the fabric during use on the paper machine. However, during the running-in or break-in phase, these fibers will play a significant role to maintain a certain fabric density. As fabrics compact, they become more dense. An ideal fabric has constant density throughout its life. This is extremely important for fabrics for tissue manufacturing and last presses on printing grade machines, for example. The fabric, as described above, will have a well-defined porous surface and density at start up. As the nonbound, nonplasticized fibers wear away and the fabric compacts, desired density and openness are maintained.

After the plasticizing process, the fabric can be washed in water or a water/detergent solution to remove any excess plasticizer. However, if some plasticizer is left and is present in the fabric, the fabric will be softer and will be easier to both install and to wet-in on the paper machine.

Other general properties and important features of press fabrics, press belts, or transfer belts produced by using the process according to the present invention can be stated as follows:

- The process of plasticizing can be restricted to a surface layer and thus the stiffening of the fabric is limited;
- The resiliency of the surface layer is excellent e.g. a porous "membrane" of PA or PA blend on top and a dampening PA structure beneath;
- The porous permeable or impermeable surface is highly resistant to high-pressure showering. i.e. the surface will have a high wear resistance.
- A coating process that is commonly used to either achieve smooth surface or the desired impermeability for the fabric or belt is avoided thereby precluding the use of additional chemicals or manufacturing time;
- The chemicals used in the process do not present any major problem from an environmental standpoint and lend themselves to industrial scale manufacturing; and
- The small amount of excess plasticizer can also remain in the fabric and act as a softening agent during installation and a wetting-in agent and then be washed out during the start up phase on the paper machine.

In a further embodiment of the present invention, the use of bicomponent fibers as a part of the fiber web or batt layer is disclosed. Such bicomponent fibers can, for example, be of either sheath-core or side by side types. Suitable polymers are e.g. coPA+PA6 (e.g. EMS fiber types BA 115 and BA 140), PA6+PA6.6 (e.g. EMS fiber type BA3100) and mixtures thereof. The use of bicomponent fibers offers several additional advantages, such as:

1. The use of a plasticizer lowers the glass transition temperature, Tg, of both polymers by 40-60° C. The temperature during the process will then be so low that the damage of the fibers due to oxidation when exposed to heat is significantly reduced. Yellowing and degradation is therefore very limited, which otherwise is a serious problem. For example, EMS fiber type KA 140 melts readily at the roll surface temperature of 110-120° C. according to the present invention, while the standard roll surface temperature is 170-180° C. without the application of a plasticizer to the fiber;
2. The final fabric surface, as well as the fibers under the plasticized layer, will have a higher wear resistance and resiliency, due to less heat damage to the component polymers;
3. In the case of PA6/PA6.6 bicomponent fibers, it is not possible to melt the low melting PA6 part of the fiber only by heat treatment without causing non-reversible damage to the fibers and yarns, because temperatures of about 240-250° C. will be needed. However, in the present invention using a plasticizer, the temperature can be limited to 170° C. or even lower, thereby enhancing fiber to fiber bonding when heat and/or pressure is applied. Moreover, the PA6 of the PA6/PA6.6 bicomponent fiber is much more wear resistant than the coPA used in the regular low melting bicomponent fibers. Thus the present invention offers a possibility to use bicomponent fibers based on PA polymers that are more suitable for papermachine clothing (PMC) applications than low-melting coPA. Bicomponent yarns similar to the bicomponent fibers disclosed herein can be used in forming the fabric or support structure, especially in those embodiments without any layers of fiber and/or batt on the fabric. These yarns, for example, can be of either sheath-core or side by side types. Suitable polymers are e.g. PA6+PA6.6 (e.g. EMS fiber type BA3100), coPA+PA6 (e.g. EMS fiber types BA 115 and BA 140) and mixtures thereof.

The invention according to one embodiment is a process or method of making the industrial fabric described in the previous embodiments. The process includes providing a support structure or fabric as described above, treating the fabric with a plasticizer, and optionally passing the fabric surface over a roll, with or without pressure, at a temperature sufficient to plasticize the surface of the fabric. The process may or may not include arranging one or more layers of batt fiber material on the support structure. Laminates of one or more of the above mentioned structures can be produced as well. An additional fibrous component such as batt produced by carding, can be attached to at least the outer surface of the base structure or fabric.

The plasticizer used in this process may be glycerol and water and the plasticizing can be controlled to a desired level and/or fabric thickness based on the amount of glycerol and water used. The plasticizer may be selected from the group consisting of but not limited to glycerin/glycerol, dipropylene-glycol, ethylene-glycol, resorcinol, diethylene glycol dibenzoate, triethylene glycol, tetraethylene glycol, bis(n-butyl)phthalate, butyl benzyl phthalate, di(n-octyl)phthalate, derivatives thereof and combinations thereof. The plasticizing of the instant invention can be controlled to a desired level and/or fabric thickness based on the amount of plasticizer used, and the degree of deformation of the surface of the fabric can be controlled based on the temperature of the roll in contact with the surface, the pressure or tension applied to the fabric or the time and/or speed of treatment.

The process may be carried out by treating the industrial fabric with the chosen plasticizer and letting the fabric pass over a hot roll (with or without a mating pressure roll). The surface in contact with the heated roll plasticizes, and forms a smooth, porous, permeable surface on the fabric. The process can also form an almost impermeable surface and subsequently be perforated by a separate process if desired. The process is controlled by letting the plasticizer migrate towards the surface to be smoothed, which is the surface facing the heated roll, and, if appropriate, simultaneously treating the fabric with slight/heavy pressure thereby causing the fibers to deform. This effect is more pronounced in fabrics having low melt fibers, where the fiber to fiber bonding is enhanced due to lowering of glass transition temperature using a plasticizer, thereby bringing them close to, or to, a melting stage, and the use of heat and pressure thereafter causes the fibers to bond thoroughly. The heat here is applied to only the paper contacting side of the fabric when the intention is to plasticize the paper side surface. Under certain conditions a pressure roll may not be needed at all.

Thus by the present invention, its objects and advantages are realized, and although preferred embodiments have been disclosed and described in detail herein, its scope and objects should not be limited thereby; rather its scope should be determined by that of the appended claims.

We claim:

1. An industrial fabric with a porous surface, the fabric comprising:

a support structure formed of a polymeric material;

wherein a surface of the fabric support structure is treated with a plasticizer sufficient to lower the glass transition temperature of the polymeric material by 40-60° C. such that the use of heat and/or pressure causes fiber flattening and densification, and wherein said plasticizer is washed out of said industrial fabric after fiber flattening and densification.

2. The industrial fabric according to claim 1, wherein said plasticizer is selected from the group consisting of glycerin/glycerol, dipropylene-glycol, ethylene-glycol, resorcinol, diethylene glycol dibenzoate, triethylene glycol, tetraethylene glycol, bis (n-butyl)phthalate, butyl benzyl phthalate, di(n-octyl)phthalate, derivatives thereof and combinations thereof.

3. The industrial fabric according to claim 1, wherein, said plasticizer comprises a mixture of glycerol and dipropylene glycol.

4. The industrial fabric according to claim 1, wherein said support structure is selected from the group consisting of woven, multilayer woven, nonwoven, knitted, extruded mesh, spiral-link, machine direction ("MD") yarn array, cross-machine direction ("CD") yarn array, spiral wound strips of woven and nonwoven materials, and combinations thereof.

5. An industrial fabric comprising a laminated structure for the base support structure comprising one or more layers of the fabric according to claim 4.

6. The industrial fabric according to claim 5, further comprising one or more layers of fibrous material attached to the laminated structure.

7. The industrial fabric according to claim 1, wherein said support structure comprises polyamide yarns (PA).

8. The industrial fabric according to claim 7, wherein said yarns are monofilament, plied monofilament, multifilament or plied multifilament, bulk continuous filament (BCF), texturized multifilament or multistrand yarns in machine direction ("MD") and/or cross-machine direction ("CD") of the fabric.

9. The industrial fabric according to claim 1, wherein said support structure comprises bicomponent yarns.

10. The industrial fabric, according to claim 9, wherein said bicomponent yarns are selected from the group consisting of coPA+PA6, PA6+PA6,6 and mixtures thereof.

11. The industrial fabric according to claim 1, wherein said industrial fabric is permeable or impermeable.

12. The industrial fabric according to claim 1, wherein said industrial fabric is a forming fabric, press fabric, press belt, transfer belt, dryer fabric, a fabric used in melt blowing or spun bonding processes, or a fabric used in textile finishing processes.

13. The industrial fabric according to claim 1, further comprising one or more layers of fibrous material attached to the support structure.

14. The industrial fabric according to claim 13, wherein said layer(s) of fibrous material comprises polyamide (PA).

15. The industrial fabric according to claim 13, wherein said layer of fibrous material comprises a blend of PA fibers and other material fibers that do not react with the plasticizer.

16. The industrial fabric according to claim 15, wherein the other material fibers are selected from the group consisting of rayon, acrylic and mixtures thereof.

17. The industrial fabric according to claim 13, wherein said layer of fibrous material comprises bicomponent fibers.

18. The industrial fabric, according to claim 17, wherein said bicomponent yarns are selected from the group consisting of coPA+PA6, PA6+PA6,6 and mixtures thereof.

19. An industrial fabric with a porous surface, the fabric comprising: a support structure formed of a polymeric material; wherein a surface of the fabric support structure is treated with a plasticizer sufficient to lower the glass transition temperature of the polymeric material by 40-60° C. such that fiber deformation is achieved by passing the fabric over and around a roll, with or without pressure and/or heat, and wherein said plasticizer is washed out of said fabric after said fiber deformation.

20. An industrial fabric with a porous surface, the fabric comprising:

a support structure formed of a polymeric material;

wherein a surface of the fabric support structure is treated with a plasticizer sufficient to lower the glass transition temperature of the polymeric material by 40-60° C. such that fiber-to-fiber bonding is achieved by passing the fabric over and around a roll, with or without pressure and/or heat, and wherein said plasticizer is washed out of said fabric after said fiber-to-fiber bonding.

* * * * *